US009388525B2

(12) United States Patent
Huang

(10) Patent No.: US 9,388,525 B2
(45) Date of Patent: Jul. 12, 2016

(54) ELECTRICAL IRONING PRESS

(71) Applicant: ANVID PRODUCTS, INC., Livermore, CA (US)

(72) Inventor: Weiyuan Huang, Livermore, CA (US)

(73) Assignee: Anvid Products, Inc., Livermore, CA (US)

( * ) Notice: Subject to any disclaimer, the term of this patent is extended or adjusted under 35 U.S.C. 154(b) by 148 days.

(21) Appl. No.: 14/471,710

(22) Filed: Aug. 28, 2014

(65) Prior Publication Data

US 2015/0376830 A1 Dec. 31, 2015

(30) Foreign Application Priority Data

Jun. 27, 2014 (CN) ..... 2014 2 0351344

(51) Int. Cl.
*D06F 71/02* (2006.01)
*D06F 71/36* (2006.01)
*D06F 71/34* (2006.01)

(52) U.S. Cl.
CPC ..... *D06F 71/026* (2013.01); *D06F 71/34* (2013.01); *D06F 71/36* (2013.01)

(58) Field of Classification Search
CPC ..... D06F 71/00; D06F 71/02; D06F 71/023; D06F 71/026; D06F 71/04; D06F 71/043; D06F 71/062; D06F 71/32; D06F 71/34; D06F 71/36; B30B 1/20
See application file for complete search history.

(56) References Cited

U.S. PATENT DOCUMENTS 1,732,890 A * 10/1929 High ..... D06F 71/34 38/15
2,180,103 A * 11/1939 Engbrecht ..... D06F 71/023 38/32
2,226,450 A * 12/1940 Strobridge ..... D06F 71/32 38/36
2,300,541 A * 11/1942 Forse ..... D06F 71/34 38/1 D
2,961,784 A * 11/1960 Foster ..... D06F 71/023 38/28
3,986,281 A * 10/1976 Darwin ..... D06F 71/323 192/129 B
4,953,300 A * 9/1990 Davidson ..... D06F 71/34 38/15
4,998,360 A * 3/1991 Lee ..... D06F 71/026 38/1 B
5,014,453 A * 5/1991 Gratsch ..... D06F 71/00 38/14
2003/0226295 A1* 12/2003 Hickle ..... D06F 71/323 38/31
2010/0299973 A1* 12/2010 Uchikoshi ..... D06F 71/08 38/18

* cited by examiner

*Primary Examiner* — Ismael Izaguirre
(74) *Attorney, Agent, or Firm* — Sheppard Mullin Richter & Hampton LLP; Alex Y. Nie

(57) ABSTRACT

An electrical ironing press comprising a meshed board and an iron board, in which the meshed board is fixedly connected with a base, the iron board is fixedly connected with a rocker arm, the base is hinged with the rocker arm, and the rocker arm is provided with a steam pipe; wherein the electrical ironing press also comprises a spring and link rods; the spring is connected with the rocker arm and the base and positioned therebetween; an end of each of the link rods is hinged with the base: another end of each of the link rods is slidably connected with the rocker arm; the electrical ironing press also comprises a locking device for locking the link rods; the steam pipe is provided with a steam regulating device. The electrical ironing press enables smooth opening and closing of the rocker arm; the iron board can also open with a sufficiently wide opening angle; users can use the electrical ironing press more safely and conveniently; amount of steam given out can also be freely adjustable by the users.

8 Claims, 3 Drawing Sheets

ELECTRICAL IRONING PRESS

This application claims priority to Chinese Patent Application CN 2014203513442, filed Jun. 27, 2014, which is incorporated by reference herein in its entirety.

BACKGROUND OF THE INVENTION

The present invention relates to an electrical ironing press.

Electrical ironing press is a kind of household electrical appliances for daily use, It brings much convenience to our lives. An electrical ironing press contains a large iron board capable to heat up and dry up several pieces of textile products having large surface areas at the same time. An example of textile products having large surface areas is a quilt. Also, the electrical ironing press can be adjusted to various different temperatures according to practical needs. Some advanced electrical ironing presses are equipped with steaming function.

Nowadays, an ironing press rotation mechanism of an existing electrical ironing press usually achieves compression self-locking by using a single spring. In this case, only one single spring is compressed. Since the spring is positioned in the middle, the angle of rotation is narrow and usually will not exceed 50 degrees due to the constraints imposed by compression self-locking and the position of the spring. Due to narrow opening angle of the iron board, it is not convenient for users to move the textile products on the iron board. When users put their hands or arms near to the inner side of the iron board, they may touch the hot iron board and get hurt.

Furthermore, those existing electrical ironing presses equipped with steaming function give out only a fixed amount of steam. The amount of steam cannot be adjusted, thereby depriving the users of their rights to freely choose the amount of steam they require. Time and energy are wasted when a large amount of steam is in fact not required.

BRIEF SUMMARY OF THE INVENTION

In view of the inconvenience during use due to the insufficient opening angle of the iron board of the ironing press, the present invention provides an electrical ironing press which is adjustable with respect to the amount of steam given out and which has an iron board capable to open with a wider opening angle. The present invention adopts the following technical proposal:

An electrical ironing press comprises a meshed board and an iron board. The meshed board is fixedly connected with a base. The iron board is fixedly connected with a rocker arm. The base is hinged with the rocker arm. The rocker arm is provided with a steam pipe. The electrical, ironing press also comprises a spring and link rods. The spring is connected with the rocker arm and the base and positioned therebetween. An end of each of the link rods is hinged with the base; another end of each of the link rods is slidably connected with the rocker arm.

The electrical ironing press also comprises a locking device for locking the link rods.

The steam pipe is provided with a steam regulating device.

Preferably, quantity of the link rods is two. The two link rods are disposed on two sides of the rocker arm respectively. A connecting rod is provided between the two link rods.

Preferably, the rocker arm is provided with a handle.

Preferably, the spring is an air spring.

Preferably, the link rods are provided with locking holes. The locking device comprises a first knob, a cam wheel and retractable rods. The first knob is connected with the cam wheel. The retractable rods abut against the cam wheel. The first knob controls insertion of the retractable rods into the locking holes to lock the link rods.

Preferably, the steam regulating device comprises a second knob, a gear and a steam regulating valve. The second knob engages with the gear. The gear connects with the steam regulating valve. Amount of steam given out from an output end of the steam pipe is controlled by the second knob.

Preferably, the first knob and the second knob are co-axial.

The electrical ironing press of the present invention enables smooth opening and closing of the rocker arm; the iron board can also open with a sufficiently wide opening angle; users can use the present invention more safely and conveniently; amount of steam given out can also be freely adjustable by the users.

BRIEF DESCRIPTION OF THE DRAWINGS

The figures described herein constitute a part of this application. The figures are intended to facilitate the understanding of the present invention but not intended to limit the scope thereof. The brief description of the figures are set out as follows.

DETAILED DESCRIPTION OF THE INVENTION

Figure 1:
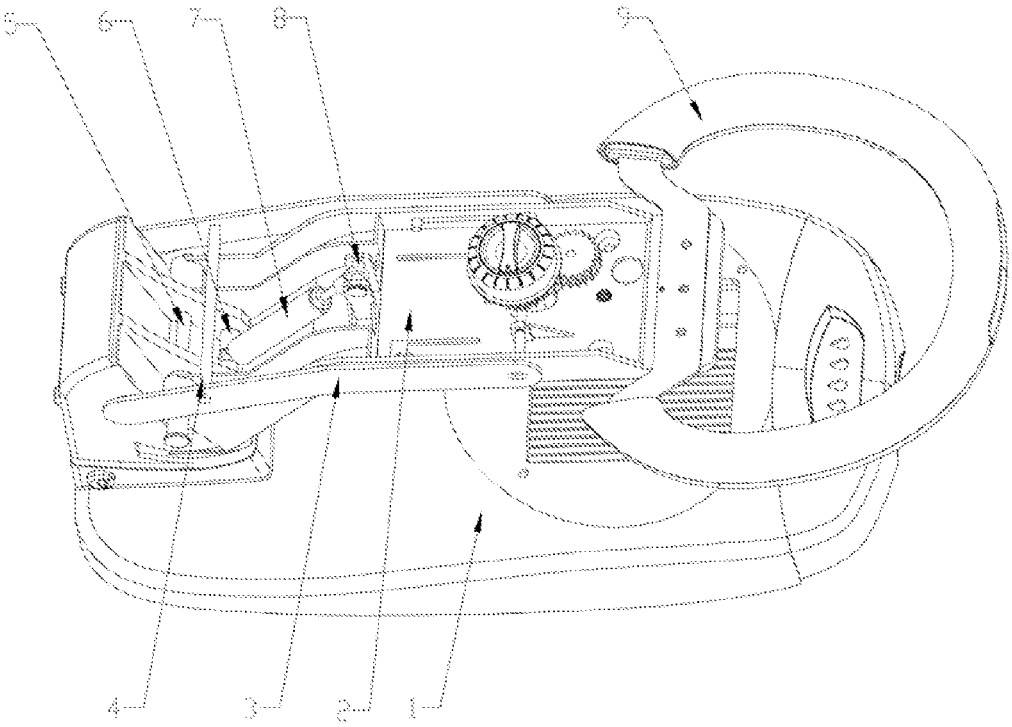
FIG. 1 is a structural view of the present invention.
Figure 2:
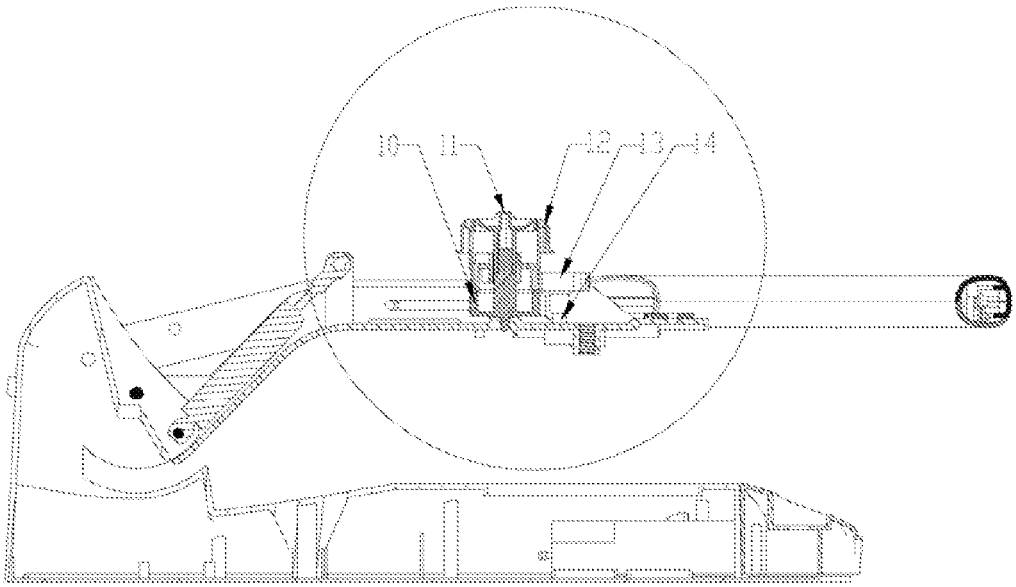
FIG. 2 is a sectional view of the present invention.
Figure 3:
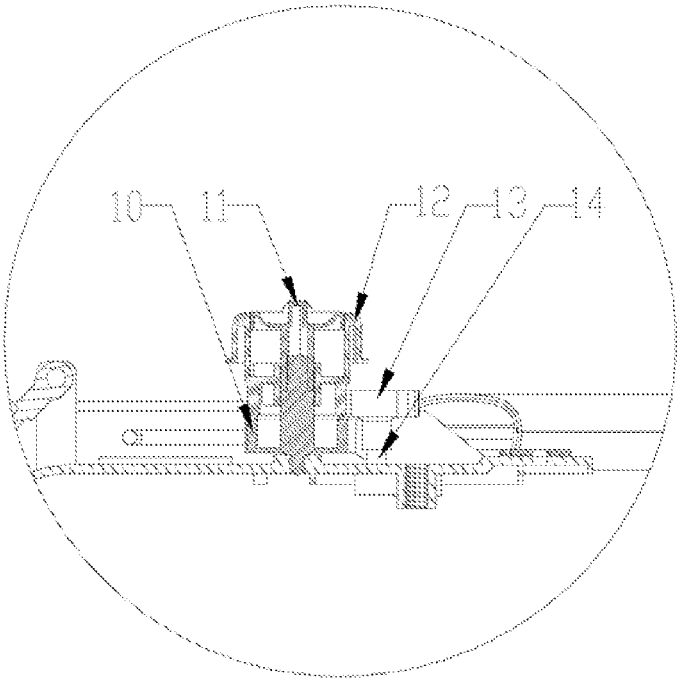
FIG. 3 is a partially enlarged view of FIG. 2.
Figure 4:
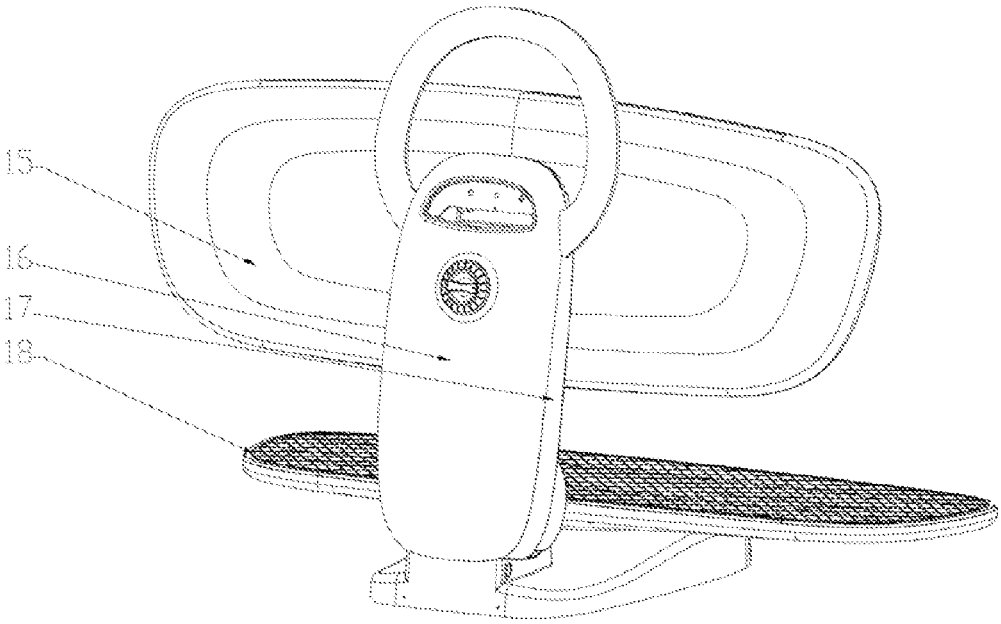
FIG. 4 is a perspective view of the present invention.

The present invention will be further described in detail below with reference to some embodiments and the accompanying drawings. The embodiments and the detailed description below are only intended to explain the present invention but not intended to limit the scope of the present invention.

Embodiments

As shown in FIGS. 1-6, an electrical ironing press comprises a meshed board 18 and an iron board 15. The meshed board 18 is fixedly connected with a base 1. The iron board 15 is fixedly connected with a rocker arm 2. The rocker arm 2 can be fixedly mounted with a handle 9 aria screws to facilitate operation. A first shaft 5 is provided on the base 1. The base 1 is hinged with the rocker arm 2 via the first shaft 5. The rocker arm 2 is also provided with a steam pipe. The electrical ironing press also comprises a spring 7 and link rods 3. The base 1 is also provided with a second shaft 6. The rocker arm 2 is also provided with a third shaft 8. The spring 7 is connected with the rocker arm 2 and the base 1 and positioned therebetween via the second shaft 6 and the third shaft 8. An end of each of the link rods 3 is hinged with the base 1 to form a rotational end; another end of each of the link rods 3 is slidably connected with the rocker arm 2 to form a slidable end. In this embodiment, quantity of the link rods 3 is two. The two link rods 3 are disposed on two sides of the rocker arm 2 respectively. A connecting rod 4 is provided between the two link rods 3 to stabilize the two link rods 3, The rocker arm 2 is also provided with a locking device capable to lock the link rods 3. Positions of the rotational end of each of the link rods 3 and the slidable end of each of the link rods 3 are interchangeable. The locking device may also be provided at the base 1. The stream pipe is also provided with steam regulating device. The rocker arm 2, the steam pipe, the link rods 3, the locking device and the steam regulating device can be mounted inside a shell formed by an upper shell 16 and a lower shell 17.

In another modified embodiment, the spring 7 is an air spring.

According to the embodiments described above, when the rocker arm 2 opens up to its widest opening angle (approximately 80 degrees), the slidable ends of the link rods 3 displace with respect to the rocker arm 2 and the support torque generated by the air spring is equal to the total gravity torque of all the moved parts, thereby maintaining the rocker arm 2 at an equilibrium at the widest opening angle. During the process of opening and closing, supporting force of the air spring varies along with the external force being exerted; therefore, unlike an abrupt variation of force at the widest opening angle when a normal spring 7 is used, variation of force on the handle 9 is very small when an air spring is used.

Figure 5:
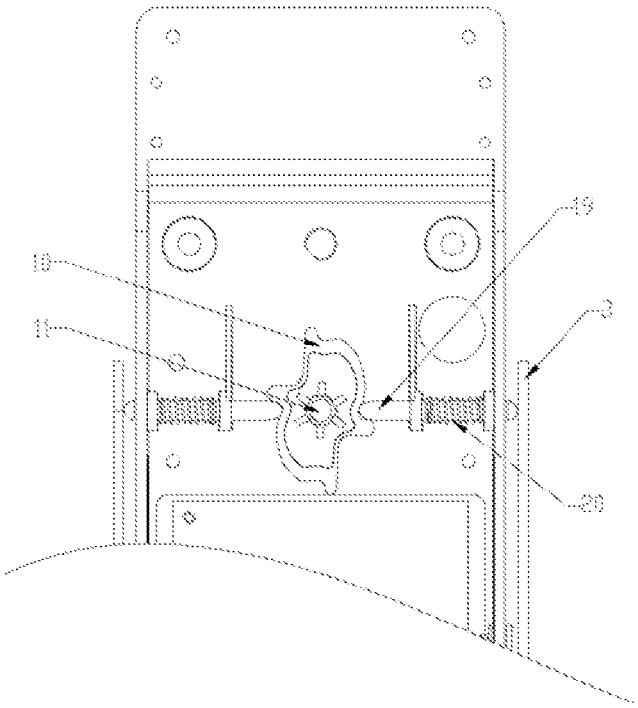
FIG. 5 is a structural view of the locking device of the present invention in an unlocked condition.
Figure 6:
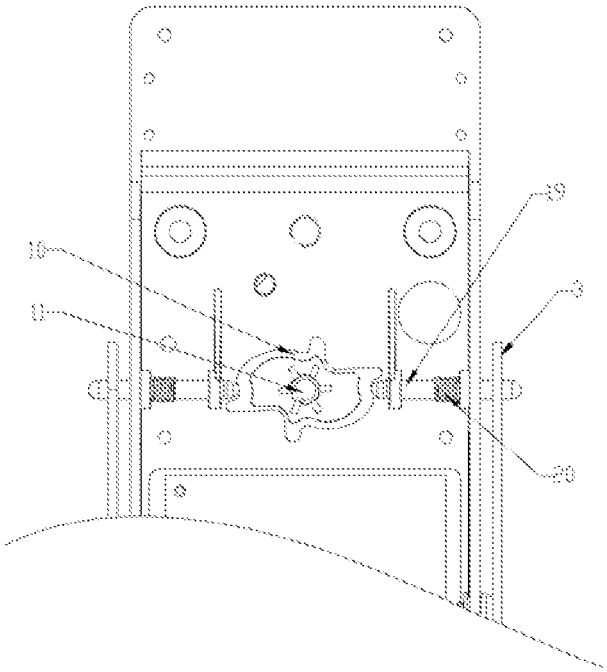
FIG. 6 is a structural view of the locking device of h present invention in a locked condition.

According to the locking device of the present invention, the link rods 3 are provided with locking holes. The locking device comprises a first knob 11, a cam wheel 10 and retractable rods 19. The first knob 11 is disposed on a shell outer surface and is connected with the cam wheel 10. The first knob 11 and the cam wheel 10 are co-axial and rotate at the same speed when they rotate. The retractable rods 19 abut against the cam wheel 10. As shown in FIG. 5, in an unlocked condition of the link rods 3, the retractable rods 19 on two sides abut in a direction towards each other against two ends of the minimum diameter of the cam wheel 10 respectively under the effect of springs 20, and the retractable rods 19 are away from the locking holes of the link rods 3. As shown in FIG. 6, when the first knob 11 rotates, the first knob 11 also drives the cam wheel 10 to rotate at the same speed; as the cam wheel 10 rotates, its diameter whose two ends are abutted against and slidably in contact with the retractable rods 19 increases, thereby pushing the retractable rods 19 outwardly to two sides and into the locking holes. The first knob 11 is therefore used for controlling insertion of the retractable rods 19 into the locking holes to lock the link rods 3; in a locked condition of the link rods 3, the rotational ends of the link rods 3, the first shaft 5 and the retractable rods 19 form a fixed triangular fixing mechanism for link rods, ensuring that the entire electrical ironing press can be lifted up by only lifting up the handle 9. Quantity of locking holes on each of the link rods can be more than one. By inserting the retractable rods 19 into different locking holes, the rocker arm 2 can be locked at different opening angles.

According to the steam regulating device of the present invention, the steam regulating device comprises a second knob 12, a gear 13 and a steam regulating valve 14. The second knob 12 is disposed on the shell outer surface and engages with the gear 13. The gear 13 sleeves on outer side of the steam regulating valve 14 so as to connect with the steam regulating valve 14. The steam regulating valve 14 is mounted above the steam pipe. When the second knob 12 is rotated, the gear 13 engaged with the second knob 12 rotates synchronously with the same magnitude, and the gear 13 also drives the steam regulating valve 14 to rotate; the amount of steam given out from an output end of the steam pipe is therefore controlled by the second knob 12.

In another modified embodiment, the first knob 11 and the second knob 12 are co-axial. In particular, a central shaft is connected at a bottom part of the first knob 11. The first knob 11 is mounted on the rocker arm 2 via the central shaft. The cam wheel 10 is fixed at a bottom end of the central shaft. The second knob 12 is in a ring shape and is disposed around outer side of the first knob 11. A bottom part of the second knob 12 is connected with a hollow shaft. The hollow shaft is disposed around outer side of the central shaft. Length of the hollow shaft is slightly shorter than length of the central shaft. A bottom end of the hollow shaft engages with the gear 13. The cam wheel 10 and the gear 13 are positioned at different heights so that they do not affect each other. Therefore, the locking device and the steam regulating device are independent from each other and do not interfere with each other. Periphery of the second knob 12 can be provided with a press cover to prevent the second knob 12 from disengagement. In this embodiment, positions of the first knob 11 and the second knob 12 are interchangeable; in other words, the first knob 11 can be positioned around outer side of the second knob 12, while other structures remain substantially similar.

Various parts of the present invention described above are assembled as follows: assemble the air spring, the second shaft 6 and the base 1 first, and then assemble the rocker arm 2, the first shaft 5 and the base 1; in a condition which no force is exerted to the air spring, use the third shaft 8 to connect the air spring and the rocker arm 2 and then mount the link rods and the connecting rod 4; after that, mount the gear 13 on the steam regulating valve 14 (the steam regulating valve 14 and the handle 9 are pre-installed on the rocker arm 2), and then mount the lower shell 17, the second knob 12. the iron board 15, the upper shell 16 and the first knob 11 in sequential order. The most important operation of the electrical ironing press by users is to operate the function buttons on the control panel; the lesser important operation of the electrical ironing press by users is to turn the second knob 12 to regulate the amount of steam; a minimum amount of steam is given out when the second knob 12 is turned to the farthest left; a maximum amount of steam is given out when the second knob 12 is turned to the farthest right. When it is not necessary to use the electrical ironing press, turn the first knob 11 in a clockwise direction by 90 degrees so that the retractable rods 19 are inserted into the link rods 3 to lock the rotation of the rocker arm 2; as such, the electrical ironing press can be carried easily, When it is necessary to use the electrical ironing press, turn the first knob 11 in an anti-clockwise direction by 90 degrees so that the retractable rods 19 disengage from the link rods 3 to allow rotation and opening of the rocker arm 2.

The present invention is described in detail above according to some embodiments. Specific examples have been used for explaining the implementation and principles of the embodiments of the present invention. The above description is only intended to assist in understanding the principles of the embodiments of the present invention, It should be noted that a person skilled in this field of art may make changes in respect of specific implementation and the scope of application according to the teaching of the embodiments of the present invention. In essence, the above description should not be understood as having any limiting effect on the present invention.

What is claimed is:

1. An electrical ironing press comprising a meshed board and an iron board, in which the meshed board is fixedly connected with a base, the iron board is fixedly connected with a rocker arm, the base is hinged with the rocker arm, and the rocker arm is provided with a steam pipe; wherein the electrical ironing press also comprises a spring and link rods; the spring is connected with the rocker arm and the base and positioned therebetween; an end of each of the link rods is hinged with the base; another end of each of the link rods is slidably connected with the rocker arm;

the electrical ironing press also comprises a locking device for locking the link rods;

the steam pipe is provided with a steam regulating device.

2. The electrical ironing press as claimed in claim 1, wherein quantity of the link rods is two; the two link rods are disposed on two sides of the rocker arm respectively; a connecting rod is provided between the two link rods.

3. The electrical ironing press as claimed in claim 1. wherein the rocker arm is provided with a handle.

4. The electrical ironing press as claimed in claim 1, wherein he spring is an air spring.

5. The electrical ironing press as claimed in claim 1, wherein the link rods are provided with locking holes; the locking device comprises a first knob, a cam wheel and retractable rods; the first knob is connected with the cam wheel; the retractable rods abut against the cam wheel; the first knob controls insertion of the retractable rods into the locking holes to lock the link rods.

6. The electrical ironing press as claimed in claim 1, wherein the steam regulating device comprises a second knob, a gear and a steam regulating valve; the second knob engages with the gear; the gear connects with the steam regulating valve; amount of steam given out from an output end of the steam pipe is controlled by the second knob.

7. The electrical ironing press as claimed in claim 5, wherein the steam regulating device comprises a second knob, a gear and a steam regulating valve; the second knob engages with the gear the gear connects with the steam regulating valve amount of steam given out from an output end of the steam pipe is controlled by the second knob.

8. The electrical ironing press as claimed in claim 7, wherein the first knob and the second knob are co-axial.

* * * * *